US007267711B2

(12) United States Patent
Liu

(10) Patent No.: US 7,267,711 B2
(45) Date of Patent: Sep. 11, 2007

(54) ELECTROSTATIC PRECIPITATOR FOR DIESEL BLOW-BY

(75) Inventor: Benjamin Y. H. Liu, North Oaks, MN (US)

(73) Assignee: MSP Corporation, Shoreview, MN (US)

( * ) Notice: Subject to any disclaimer, the term of this patent is extended or adjusted under 35 U.S.C. 154(b) by 274 days.

(21) Appl. No.: 10/925,450

(22) Filed: Aug. 25, 2004

(65) Prior Publication Data

US 2005/0061152 A1 Mar. 24, 2005

Related U.S. Application Data

(60) Provisional application No. 60/505,176, filed on Sep. 23, 2003.

(51) Int. Cl.
*B03C 3/68* (2006.01)

(52) U.S. Cl. ..... 96/21; 96/22; 96/80; 96/81

(58) Field of Classification Search ..... 96/20–24, 96/80–83; 95/5–7; 323/903
See application file for complete search history.

(56) References Cited

U.S. PATENT DOCUMENTS

| | | | | |
|---|---|---|---|---|
| 342,548 | A | 5/1886 | Walker | 95/57 |
| 895,729 | A | 8/1908 | Cottrell | 95/73 |
| 1,204,907 | A | 11/1916 | Schmidt | 96/96 |
| 1,250,088 | A | 12/1917 | Burns | 95/75 |
| 1,329,285 | A | 1/1920 | Brownlee | 285/131.1 |
| 1,605,648 | A | 11/1926 | Cooke | 96/66 X |
| 1,994,259 | A | 3/1935 | Thorne | 96/88 X |
| 2,085,349 | A | 6/1937 | Wintermute | 96/65 X |

(Continued)

FOREIGN PATENT DOCUMENTS

DE 37 02 469 A1 8/1988

(Continued)

OTHER PUBLICATIONS

Official European Search Report; PCT/US2004/030628; Mar. 11, 2005.

(Continued)

*Primary Examiner*—Richard L. Chiesa
(74) *Attorney, Agent, or Firm*—Westman, Champlin & Kelly, P.A.

(57) ABSTRACT

A compact electrostatic precipitator is designed specifically for use in connection with eliminating particles from crankcase emissions of a Diesel engine. Such emissions may carry solid soot particles as well as suspended oil droplets. The electrostatic precipitator has an electrode housing in which a high voltage electrode is mounted, and the emissions from the crankcase of a Diesel engine are passed across the electrode to an outlet. A high voltage power supply is mounted in a separate housing, and the output of the high voltage power supply is connected to the electrode only when the electrode housing and the power supply housing are properly mated, to thereby disable the high voltage connection to the electrode when the power supply housing is removed. A current limiting device is used in the circuit to the power supply to prevent high currents from being carried if any arcing occurs, and a normally open switch is closed to provide input power to the high voltage circuitry only when the power supply housing and the electrode housing are mated.

15 Claims, 6 Drawing Sheets

U.S. PATENT DOCUMENTS

| | | | | | |
|---|---|---|---|---|---|
| 2,129,783 | A | | 9/1938 | Penney | 96/79 |
| 2,142,129 | A | | 1/1939 | Hoss et al. | 96/66 |
| 2,509,548 | A | | 5/1950 | White | 96/82 |
| 2,767,359 | A | * | 10/1956 | Larsen et al. | 361/227 |
| 3,188,784 | A | * | 6/1965 | Nodolf | 96/22 |
| 3,622,839 | A | * | 11/1971 | Abrams et al. | 96/21 |
| 3,643,405 | A | * | 2/1972 | Vukasovic et al. | 96/21 |
| 3,648,437 | A | * | 3/1972 | Bridges | 96/20 |
| 3,745,749 | A | * | 7/1973 | Gelfand | 96/21 |
| 3,910,779 | A | | 10/1975 | Penney | 96/66 |
| 3,999,964 | A | | 12/1976 | Carr | 96/59 |
| 4,029,482 | A | | 6/1977 | Postma et al. | 96/66 X |
| 4,222,748 | A | | 9/1980 | Argo et al. | 96/66 X |
| 4,562,522 | A | * | 12/1985 | Adams et al. | 96/23 |
| 4,578,088 | A | | 3/1986 | Linscheid | 96/88 X |
| 4,890,455 | A | | 1/1990 | Leonhard et al. | 60/275 |
| 5,006,134 | A | | 4/1991 | Knoll et al. | 96/88 |
| 5,024,685 | A | | 6/1991 | Torok et al. | 96/96 X |
| 5,556,448 | A | * | 9/1996 | Cheney et al. | 95/6 |
| 5,639,294 | A | * | 6/1997 | Ranstad | 95/6 |
| 6,221,136 | B1 | | 4/2001 | Liu et al. | 96/66 |
| 6,245,131 | B1 | | 6/2001 | Rippelmeyer et al. | 96/18 |

FOREIGN PATENT DOCUMENTS

| | | |
|---|---|---|
| DE | 0 307 656 | 3/1989 |
| DE | 39 30 872 A1 | 3/1991 |
| EP | 0 044 361 | 1/1982 |
| EP | WO99/61159 A | 12/1999 |
| GB | 2 265 557 A | 10/1993 |

OTHER PUBLICATIONS

Written Opinion; PCT/US2004/030628; Mar. 11, 2005.

* cited by examiner

ELECTROSTATIC PRECIPITATOR FOR DIESEL BLOW-BY

This application claims priority on U.S. Provisional Application Ser. No. 60/505,176 filed Sep. 23, 2003, and the contents of which Provisional Application Ser. No. 60/505,176 are incorporated by reference.

The present invention relates to improvements over the disclosure of U.S. Pat. No. 6,221,136, which issued Apr. 24, 2001, the contents of which is incorporated by reference.

BACKGROUND OF THE INVENTION

The present invention relates to an Electrostatic Precipitator that is particularly adapted for use in connection with diesel engines for removing particulate matter from crankcase gases prior to venting the gases to the atmosphere or returning the gases into the intake manifold for exhaust gas recirculation. More particularly, the present invention relates to certain improvements in the high voltage power supply to make it more suitable for Diesel blowby gas filtration. The invention also relates to mounting the high voltage power supply in a separate housing that can be completely separated from the precipitator electrode and electrode housing in a manner that minimizes the likelihood of a continued high voltage charge on the electrode as the power source housing is removed from the electrode housing.

U.S. Pat. No. 6,221,136 describes a compact, high efficiency electrostatic precipitator for collection of aerosols containing suspended droplets and particles in a gas. As the dirty gas containing suspended droplets and other forms of particulate matter is passed through the precipitator the droplets and other forms of particulate matter are charged by the corona ions generated by a high voltage electrical discharge from a fine wire. Some of the particles may also carry a natural electrical charge as a result of the particle formation process in the Diesel engine combustion chamber and the blowby gas in the crankcase. The applied high voltage then causes the charged droplets and particles to migrate toward an adjacent grounded surface where they are collected, and the droplets and particulates are allowed to drain off by gravity to a sump.

The electrostatic precipitator section disclosed in U.S. Pat. No. 6,221,136 is particularly suited for use with a Diesel engine to remove suspended droplets and particles from a blowby gas. The blowby gas has its origin in the high temperature, high-pressure combustion gas formed inside the combustion chambers of the Diesel engine. Some of this high-temperature, high-pressure gas can leak past the piston rings of the Diesel engine to the crankcase. This gas contains both unburned Diesel soot as well as lubricating oil droplets formed as the blowby gas flows past the piston rings, where it encounters and atomizes the lubricating oil film to form droplets. The blowby gas thus contains both lubricating oil droplets as well as unburned Diesel soot.

In the past, the blowby gas usually was vented to the atmosphere directly. Concerns about air pollution from motor vehicles in general, and from the Diesel-powered vehicles in particular, have led to regulations that would require particulate emissions from Diesel engines to be greatly reduced. The electrostatic precipitator described in U.S. Pat. No. 6,221,136 is particularly suited for this application because of its small and compact size, its high efficiency for droplet and particle collection, and the low pressure drop created by the blowby gas as it flows through the device for droplet and particle removal.

In addition, the electrostatic precipitator collects not only the suspended oil droplets in the blowby gas, but also the dry, solid Diesel soot. The dry soot particles normally would cling to the surface on which they are collected. However, in the presence of oil drops in the blowby gas from a Diesel engine, a thin film of oil is formed on the collecting surface. The soot particles are thus collected onto this liquid thin film and are carried away as the oil film drains off from the collecting surface by gravity, thus returning both the oil and Diesel soot into the crankcase of the engine. As a result, the collecting surface in the electrostatic precipitator can remain relatively clean over long periods, thus insuring the reliable operation of the device over a long lifetime.

The operation of the electrostatic precipitator is dependent upon a power source to provide a high-voltage DC power to the high voltage electrode in the electrostatic precipitator. The DC high voltage needed may range up to 20,000 volts or more. The presence of this high voltage must be addressed in order to avoid accidentally having a person come in contact with the high voltage. The high voltage DC power source may also cause arcing and the emission of electromagnetic waves that can interfere with the engine control computer and other sensitive electronic circuitry nearby. For these reasons, the design of the high voltage power supply and its coupling to the electrostatic precipitator in Diesel blowby applications are both very important.

SUMMARY OF THE INVENTION

The present invention relates to an electrostatic precipitator construction which utilizes a separate high voltage DC power supply in a power supply housing that can be assembled onto an electrode housing or body used for the precipitator to form a complete electrostatic precipitator unit.

The power supply is capable of being coupled to the precipitator housing using a high voltage connection made so that when the power supply housing is in place on the electrostatic precipitator housing there is an electrical connection to the high voltage power supply. The high voltage connection is opened when the high voltage power source housing is removed so the electrode is no longer carrying power.

The lower precipitator housing has a dirty gas inlet and a clean gas outlet, as shown in U.S. Pat. No. 6,221,136. The power supply circuitry is designed to provide the needed D.C. voltage to the precipitator electrode, but the connection and mounting of the power supply housing of the present invention disconnects the high voltage source from the electrode if the power supply housing is removed from the precipitator or electrode housing. The high voltage source is again connected to the electrode when the power supply housing is installed on the electrode housing.

Additionally, problems with electromagnetic interference (EMI) are minimized by providing suitable shielding, and eliminating any gaps or crevices between the power supply housing and the precipitator electrode housing. The high frequency EMI disturbances may be carried from the high voltage output side of the high voltage power supply circuit to the low voltage input side of the circuitry, and carried by the low voltage input wires outside the power supply housing, where they can radiate electromagnetic waves. Circuitry preferably is provided to shunt the high frequency signals generated by any arcing that might occur to ground. The shunt circuitry permits the DC input voltage to pass through essentially unimpeded, but will reduce the high frequency emissions carried on the input lines which are generated in or transmitted through the high voltage electronic power supply circuitry. Such shunt circuitry can include high pass filters, for example, or other circuits that will shunt high frequency noise to ground, but will block the DC input voltage from being directly connected to ground.

Also, current limiting circuits or circuit components are provided on the output of the high voltage transformer or converter circuit so that if arcing does occur, the current is controlled and limited.

DETAILED DESCRIPTION OF THE ILLUSTRATIVE EMBODIMENTS

Figure 1:
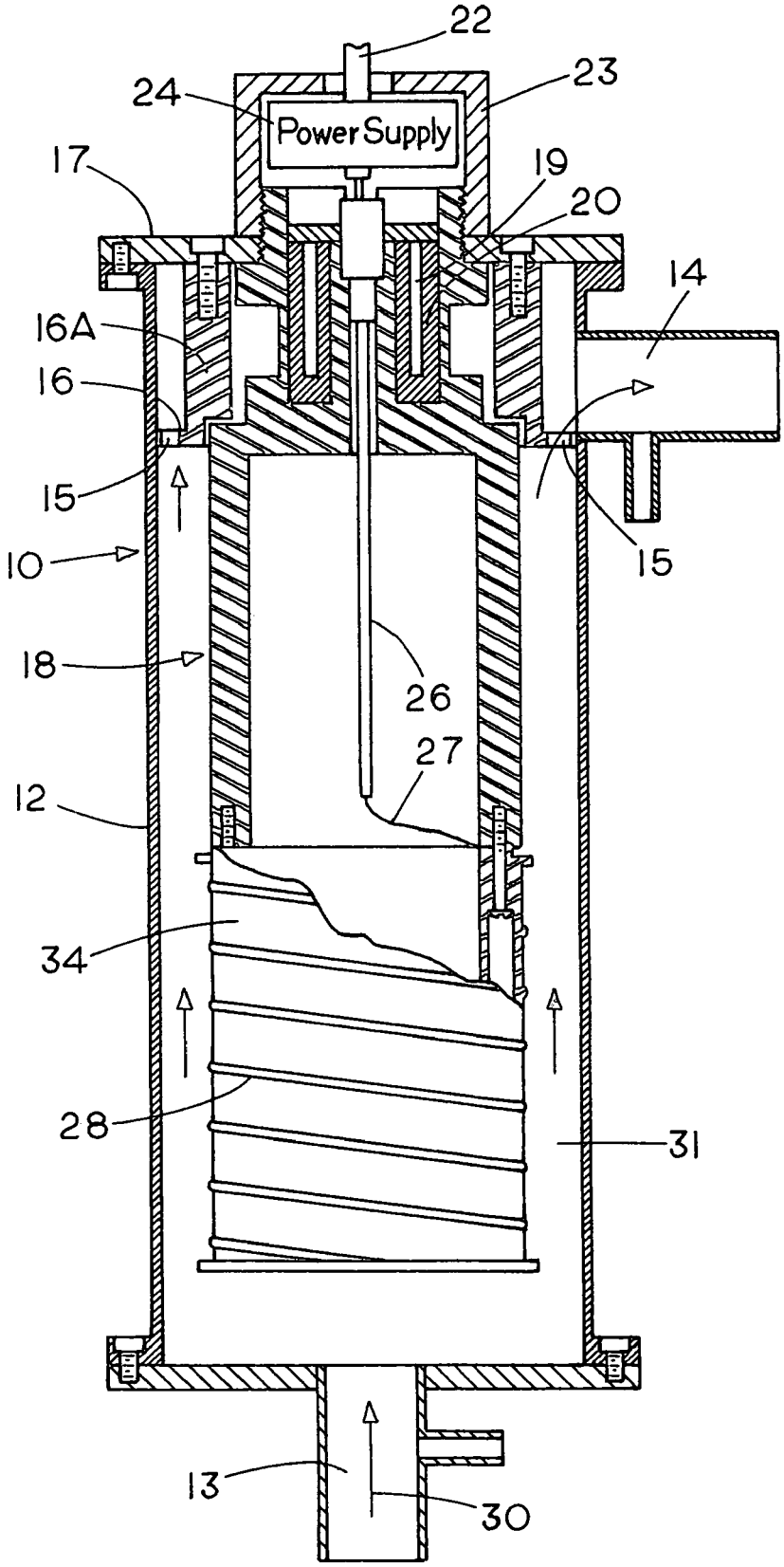
FIG. 1 (PRIOR ART)
FIG. 1 is a cross sectional view of the prior art device shown in FIG. 14 of prior art U.S. Pat. No. 6,221,136.

FIG. 1 is a vertical cross-sectional view of a prior art compact electrostatic precipitator 10. A conductive sleeve or housing 12 forms a passage for fluid, with an inlet connection 13 for receiving an aerosol, and an outlet connection 14. Conductive sleeve 12 is also a collector electrode. A flow passageway is defined by a plurality of openings 15 in a housing plate 16 that is supported on a sleeve 16A, which is positioned at the upper end of the conductive sleeve 12, and is supported on a cap plate 17.

An insulated main electrode support 18 is supported on the cap plate 17 in a suitable manner with an insulator block that includes cartridge heaters 19. The cartridge heaters are mounted in a heat conducting jacket 20. The jacket 20 distributes the heat uniformly to its outer surface and keeps the insulator support surface hot and clean to avoid contamination by vapor condensation and particle deposition.

A power connection line 22 can be passed out through a central opening of a cap 23. As shown, a power supply 24 which provides the high voltage for the discharge electrode can be potted in the cap 23, and the connector line or rod 26 can be within the precipitator and does not have to extend through the cap. The line 22 can be relatively low voltage, for example, a 24-volt supply could be provided. The heaters 19 also would be connected generally to a 12 or 24 volt supply.

The electrode support 18 has an interior passageway in which the high voltage connection rod or line 26 extends, and a thin electrode connector wire 27 extends for connection directly to the electrode wire 28 that, as shown, is helically wrapped around the insulating electrode support 18. The electrode wire 28 is shown larger than actual size and is a thin wire. Various other ways of supporting the thin electrode wire on a solid support and the spacing between the wire segments on the electrode and the distance between the wires and the grounded cylinder are discussed in U.S. Pat. No. 6,221,136.

The aerosol flow comes into the sleeve collector electrode 12 as shown by the arrow 30, and the aerosol flows up and around the passageway 31 between the high-voltage electrode wire 28 and the collector electrode 12, which is the outer metal sleeve housing. The collector electrode 12 is a solid (imperforate) member that can either be stainless steel, for example, or could be a conducting plastic. As the flow passes through the space between the electrode wire 28 and the interior of collector electrode sleeve 12, the particles are charged by the corona ions produced by the wire electrode 28. Some of these particles are precipitated onto the collector electrode sleeve 12 in this region. The remaining particles are carried by the gas to the upper part of the assembly in the space between a thin metal sleeve 34 on the outside of support 18, and the collector electrode sleeve 12. The sleeve 34 is connected to the high voltage source. The remaining particles are precipitated onto the collector electrode sleeve 12 by virtue of the high voltage on the electrode 28. The flow then goes up through the openings 15, and out through the outlet 14, as shown.

Figure 2:
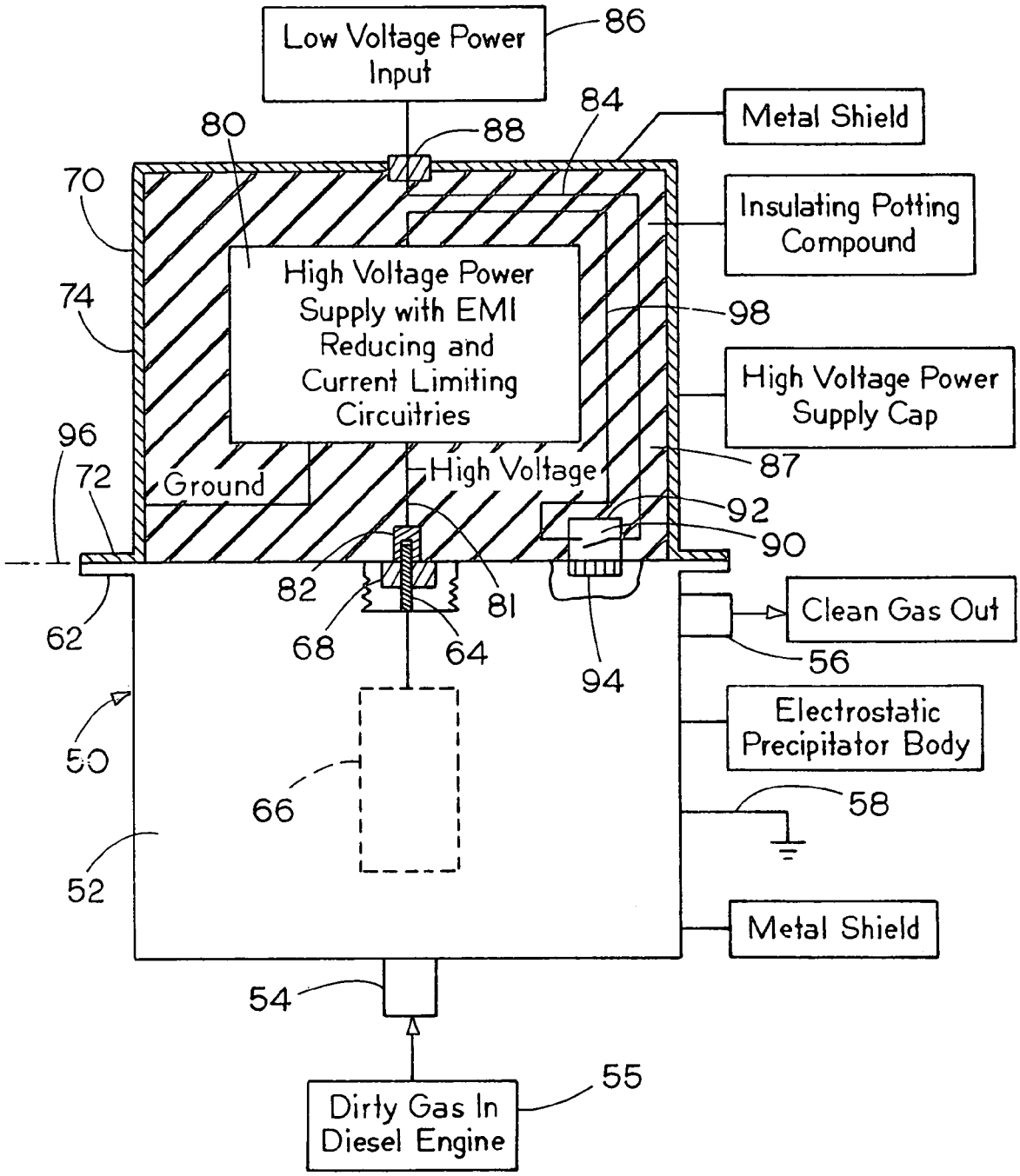
FIG. 2 is a schematic representation of the high voltage power supply housing shown joining an electrostatic precipitator electrode body, and illustrating a typical electrical coupling used for the high voltage connection.

In FIG. 2, an electrostatic precipitator shown generally at 50 has a lower electrically conductive electrode housing or sleeve body 52 that has an internal precipitator electrode 66 mounted thereon. Precipitator electrode 66 is similar in construction shown in the prior art device of FIG. 1.

The electrode housing 52 forms a gas flow path and has a dirty gas inlet 54 that is connected to the crankcase of a Diesel engine 55. A clean gas outlet 56 from the electrode housing 52 discharges to a suitable location, such as back to the air intake of the diesel engine, or to a filter and then to the atmosphere.

The electrode housing 52 is made of a conductive material, and is connected to ground through line 58 so that it is grounded. The electrode housing 52 includes a peripheral flange 62 around the periphery that extends outwardly laterally and encircles the electrode housing 52. In addition, the precipitator electrode 66 has an internal connecting prong or pin 64 connected thereto on the interior of the electrode housing 52. The precipitator electrode 66 comprises an insulating support and a fine, helically wound wire, constructed generally as shown in FIG. 1. Pin 64 is mounted on an insulating block 68 so that the pin 64 is insulated from the electrode housing 52, which is grounded. The pin 64 protrudes upwardly beyond the plane 96 of the top of flange 62.

A high voltage power supply housing 70 is made of a conductive material, and has a lower flange 72 that encircles a cylindrical wall 74 of the housing 70 and mates with the flange 62. Suitable fasteners can be used for joining the flanges 62 and 72 together, and if desired, a thin conductive gasket can be placed between the flanges. The high voltage power supply circuit or transformer indicated generally at 80 is known circuitry and is represented as a block. The circuitry is shown in greater detail in FIG. 3.

The power supply circuit 80 changes a low voltage input to the 15 to 20,000 volts or more needed at the precipitator electrode 66. The high voltage circuitry output line 81 is connected to a connector 82 that has an interior receptacle or jack that slidably fits over the outward extending portion of the pin 64 to make the high voltage connection to the precipitator electrode on the interior of the lower electrode housing 52.

Figure 3:
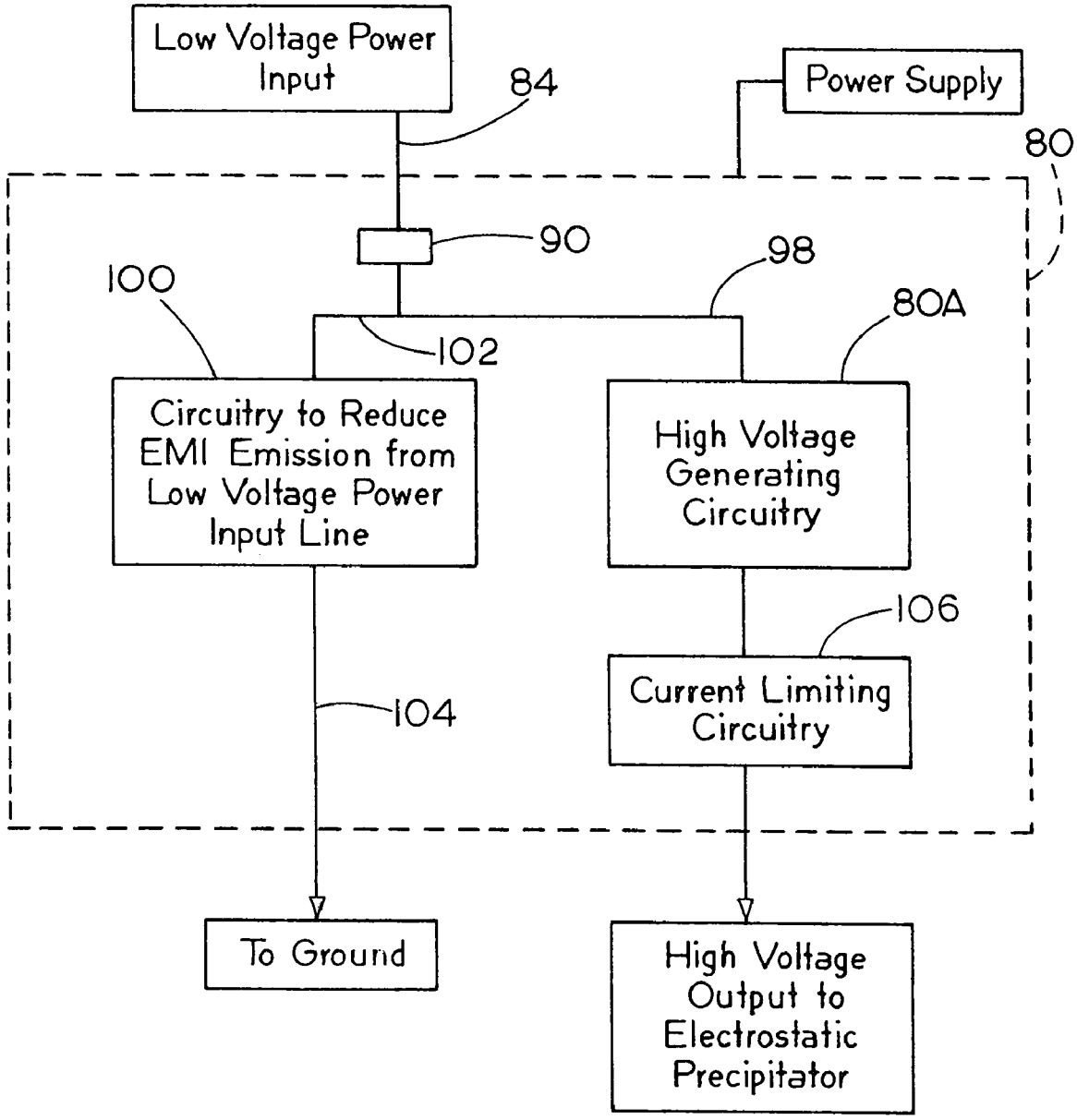
FIG. 3 is a schematic block diagram of a typical high voltage power supply used in the precipitator shown in FIG. 2.

This connector 82 is also shown in FIG. 3, where the power supply housing 70 is shown positioned above the electrode housing 52. A low voltage input line 84 leads from a low voltage input power supply 86 such as a 12 or 24 volt battery. Line 84 extends through an insulator 88 to the interior of the power supply housing 70. The line 84 is connected to the high voltage power supply circuitry through a magnetically actuated, normally open proximity switch 90. The switch 90 is in a housing 92 that is positioned to be directly above a magnet 94 that is supported in a suitable manner on the electrode housing 52 close to the plane 96 of the flange 62 or, in other words, close to the interface plane between the flanges 62 and 72. The output side of the switch 90 is connected to a line 98 that connects to the input side of the high voltage conversion or transformer circuitry 80. The voltage is boosted to the 15,000 to 20,000 volt or higher range by the circuitry 80 using known circuitry for producing high DC voltage outputs.

The components for the high voltage power supply circuit are illustrated in block diagram form in FIG. 3. The entire interior chamber of power supply housing 70 is filled with an insulating potting compound 87 to pot the circuit components in place. The high voltage generating circuit is shown at 80A.

It is desired to reduce the likelihood of high frequency electromagnetic interference (EMI) being carried back through the lines 98 and 84. If the EMI is carried on lines 98 and 84 outside the shielding of the metal power supply housing 70, the EMI could cause interference with critical components such as computers on a vehicle. A circuit 100 is connected with a line 102 to the line 98, and to the ground with a line 104. The circuit 100 includes known components to shunt the high frequency electromagnetic interference signals to ground, and thus prevent radiation of such high frequency signals from the lead in wire 84 in a manner that may interfere with vehicle operation or the like.

The low voltage DC signal to the input of the high voltage generating circuitry 80A is not shunted to ground.

It also is of importance to limit the current that can be generated from the high voltage power supply and in particular from the output of the high voltage generating circuit 80A in the event that there is an arc generated from the high voltage generating circuit 80A to ground, which can damage the connectors, the circuitry, or the like. A high current flows through the arc. The physical damage to the connectors, circuitry or electrodes will shorten the life of the device.

Current limiting circuitry 106 is provided on the output line of the high voltage generating circuit 80A. The circuitry 106 is known and can be either an active circuit or a passive circuit. For example, a passive circuit could be a high value resistor limiting the current flow from the high voltage generating circuit 80A in the event of an arc. Active current limiting circuitry is well known in current limiting devices and can be used on the output line of the high voltage generating circuit 80A.

Figure 4:
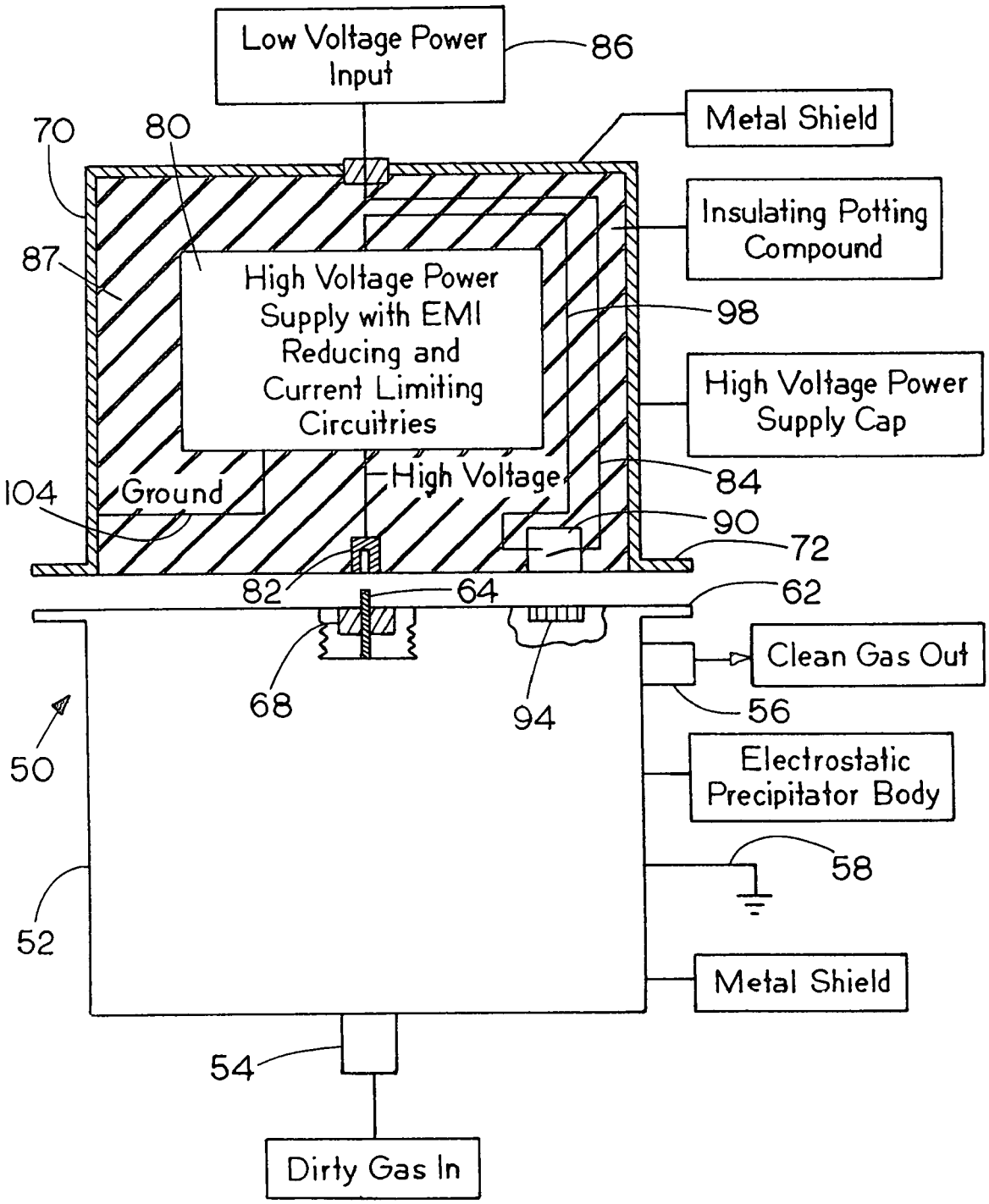
FIG. 4 is a schematic exploded view of the electrostatic precipitator of FIG. 2.

In FIG. 4, the position of the power supply housing 70 relative to the electrode housing 52 is such that the magnetic switch 90 is spaced from the magnet 94 sufficiently so that the switch is open, to illustrate that when the flanges 62 and 72 are separated the input switch for the high voltage power supply 80 remains open. When the flanges 62 and 72 are seated, there is a magnetic field that will close the switch 90 in the line 84 to the high voltage generating circuitry 80A in the high voltage power supply 80.

The normally open proximity switch ensures that when the power supply housing 70 and the electrode housing 52 are separated, the switch 90 will open, so that the high voltage generating circuitry 80A is no longer energized. Contact with the connector 82 when it is carrying the high voltage is unlikely. The connector 82, pin 64 and the electrode 66 in FIG. 2 will be completely disconnected from the high voltage power supply when housings 52 and 70 are separated.

Figure 5:
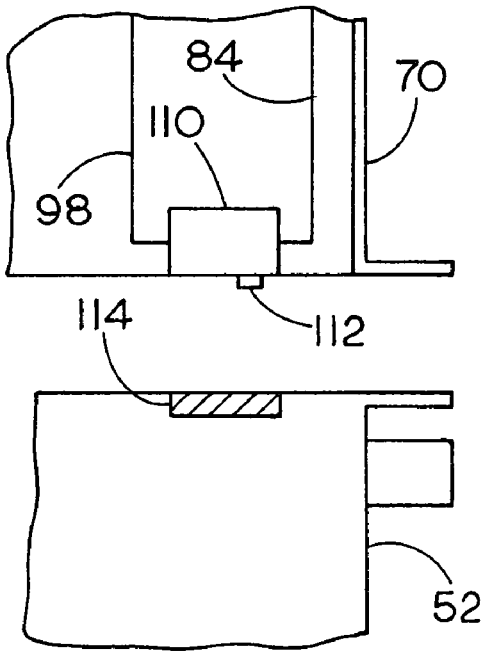
FIG. 5 is a schematic representation of a modified switch for input power connections.

FIG. 5 shows a portion of the power supply housing 70 with a mechanically actuated switch 110 in the input power line mounted on the housing 70. Switch 110 can be a normally open micro switch. The switch 110 has an actuator button 112, and is engaged by a switch actuator 114 on the electrode housing 52. When the flanges 62 and 72 are mated, the actuator 114 will strike the button 112 and close the switch 110 so that the input power circuit to the high voltage power supply is closed.

Figure 6:
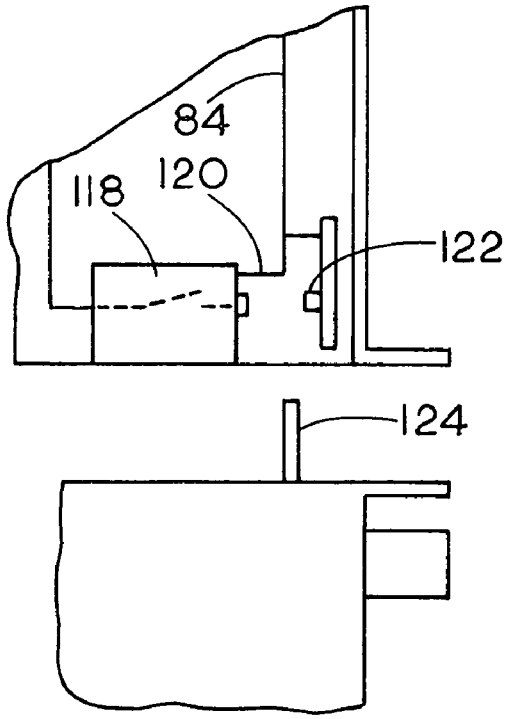
FIG. 6 is a schematic representation of a further modified form of switch for the input power.

An additional type of switch for the input power line is shown in FIG. 6, where a photosensitive electric switch 118 is provided in the input power line. When the input line 84 is connected to a power supply such as a 12 volt battery, an LED 122 will light. A jumper 120 connects line 84 to switch 118. LED 122 will shine into the photosensitive switch 118 to keep the internal switch open, but when a light obstructing blade 124 mounted on the electrode housing 52 is in position, that is, when the flanges 62 and 72 are mated, the blade 124 will interrupt the light from LED source 122 and cause the photosensitive switch 118 to close, thereby closing the circuitry to the high voltage power supply circuit.

The feature of having the high voltage power supply in a separate housing 72 that is easily separated from the high voltage electrode in electrode housing 50 along a dividing plane can be accomplished with other types of mating portions of the housing, such as a telescoping rim on the power supply housing that could either go inside or outside the rim of the electrode housing 52 for the electrostatic precipitator electrode 66. The connection between the high voltage transformer circuit and the electrostatic precipitator electrode is such that when the power supply housing 70 is seated, there is a connection from the high voltage power supply 80 to the electrostatic precipitator electrode 66.

The direction of movement for seating and separating the power supply housing 70 from the electrode housing 52 is preferably linear. The linear movement simplifies coupling and uncoupling the connectors. The housings 52 and 70 are not threaded together.

The connection from the high voltage power supply 80 to the electrode 66 can be accomplished with the linearly interfitting connector 82 and pin 64, such as that shown, or can be accomplished with clips and other types of mating connectors where two connector parts mate together linearly to create an electrical connection. Likewise, as pointed out above, the proximity switch 90, which shown is a magnetic switch on the input side of the high voltage power supply, can be replaced with other types of proximity detector switches that will complete a circuit to the input side of the high voltage power supply 80 only when the two housings, one for the power supply, and the other for the electrostatic precipitator electrode, are properly seated.

Figure 7:
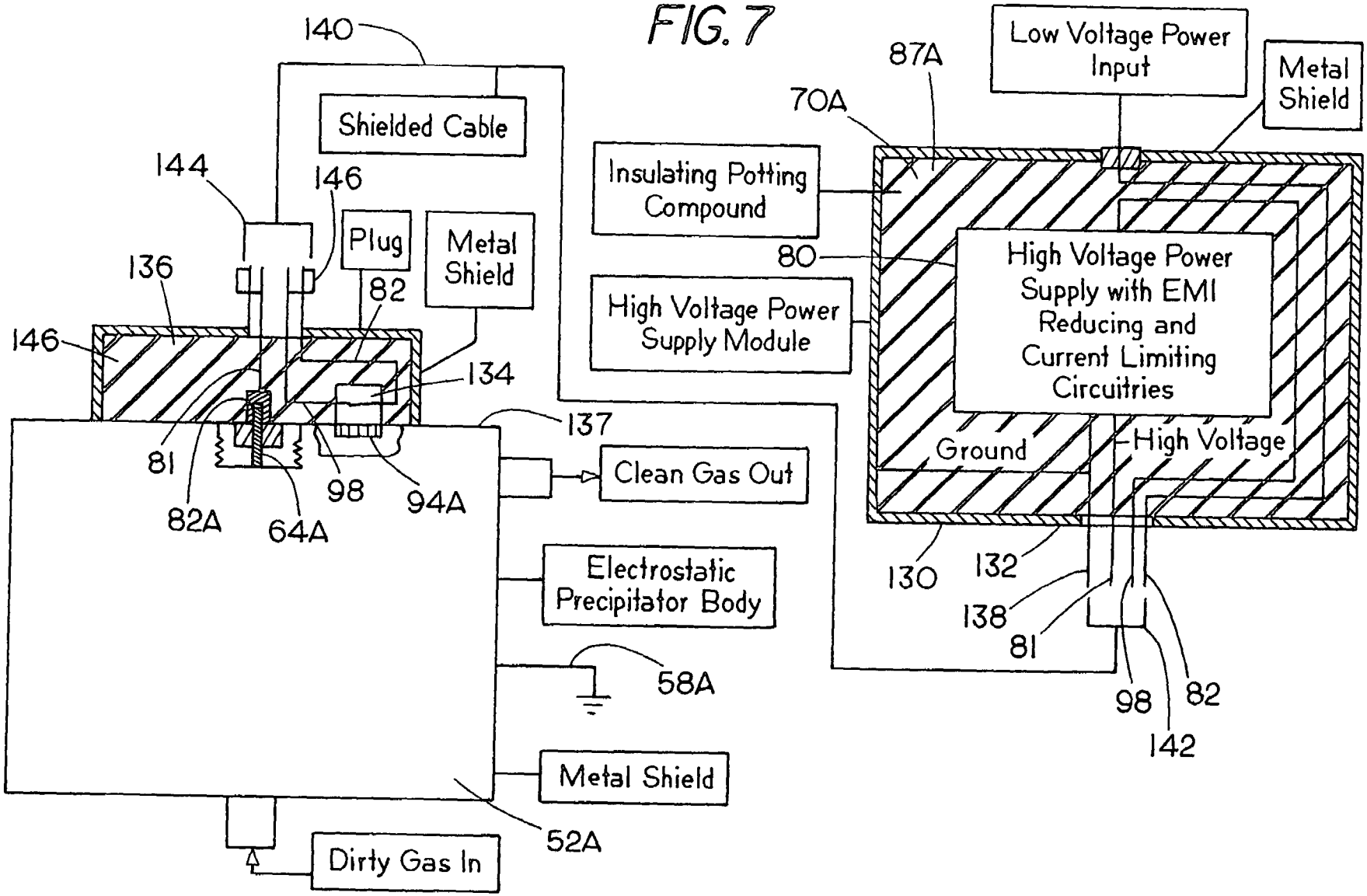
FIG. 7 is a modified high voltage power supply for the precipitator of FIGS. 2 and 4.

FIG. 7 illustrates a modified connection that keeps the entire housing 70A for the high voltage power supply separate from the electrode housing 52A, but yet has a connection for insuring that the high voltage power is applied to an output connector only when there is a connection of the components to the electrode.

In FIG. 7, a high voltage power supply housing indicated at 70A is essentially the same as that shown before, except that the interior is enclosed with a lower wall 130, which has an outlet opening 132 through which the lines 82 and 98 pass. The lines are for connection to a proximity control switch 134. The control switch 134 is mounted in a separate metal housing or plug 136, and this plug is connected to a modified precipitator housing 52A. The housing 52A is the same as that shown at 52, except it has an upper wall 137 that is made of metal that encloses the electrostatic precipitator.

High voltage line 81 also passes through the opening 132, as does a ground line 138. The ground line is part of the system for providing the high frequency signal shunt. The housing 52A is connected to a ground line 58A. A shielded cable represented at 140, has an outer high frequency emission shield, and is provided with an adequate number of conductors to carry the lines 82, 98, 81 and 138. One end of the cable 140 is connected with a suitable connector 142 to a mating connector on the housing 70A, and also has a connector 144 at its opposite end that is connected to a connector 146A the plug 136. The shielded cable 140 may have its conductors directly wired to the corresponding lines in the plug 136, which are numbered the same.

The switch 134, again, is a normally open switch such as that shown at 90, and it is magnetically actuated with a magnet 94A in the housing 52A. The plug 136 has a connector socket 82A that connects to a pin 64A as was shown in FIG. 2.

It can be seen therefore that the high voltage power supply can be completely shielded by the housing 70A, and shielding can continue through a connecting cable 140 to a plug 136 that would connect up the high voltage socket 82A and the pin 64A. The proximity switch 134 that is shown operated with the magnet 94A, will be such that it will be open to disconnect power to the input of circuit 80 in housing 70A if the plug 136 is removed from the housing 52A. The connector 82A will no longer be at the high voltage. The plug 136 can be filled with potting compound 146, and held in place with suitable fasteners. Also, it can be seen that the chamber in the housing 70A is filled with an insulated potting compound 87A as well.

The high voltage power supply 80 carries the same number, inasmuch as it is exactly the same as that shown in FIG. 2.

The advantage of having shielded sources, and the EMI reducing and current limiting circuitries mounted in a shielded housing, carried along a shielded cable to a plug that has the proximity switch 134 for interrupting power when the plug 136 is disconnected, are available with a separate power supply housing.

Although the present invention has been described with reference to preferred embodiments, workers skilled in the art will recognize that changes may be made in form and detail without departing from the spirit and scope of the invention.

What is claimed is:

1. An electrostatic precipitator for Diesel blowby filtration comprising, first and second separable shielded housings, a high voltage electrode in the first housing, the first housing having a connection for incoming gas and an outlet for gas that has passed by the high voltage electrode, a high voltage power supply in the second housing and having a low voltage input line connectable from an external low-voltage source, the high voltage power supply including a circuit generating an output of a substantially higher voltage than the low voltage source, the high voltage power supply including circuitry to limit output current in the event of an arc, and circuitry to reduce emission of electromagnetic radiation that can interfere with sensitive electronic equipment nearby, and a separable connector between the high voltage electrode and an output of the high voltage power supply such that when the two housings are brought together, the high voltage electrode and the separable connector become electrically connected, and become disconnected when the first and second housings are separated.

2. The electrostatic precipitator of claim 1 further comprising a switch to interrupt the low voltage input line to prevent high voltage from being generated by the high voltage power supply as an output upon occurrence of selected events.

3. The electrostatic precipitator of claim 2, wherein said switch to interrupt the low voltage input line comprises a normally open switch placed in the low voltage input line of the high voltage power supply and in the second housing, and an actuator on the first housing for causing said normally open switch to close when the actuator is near said normally open switch.

4. The electrostatic precipitator of claim 3, wherein the first and second separable shielded housings form a completely shielded unit for the precipitator when the housings are brought together, and said actuator on the first housing being brought near the normally open switch in the second housing, to cause the switch to close to provide low voltage input power to the high voltage power supply to generate high voltage for the high voltage electrode when the housings are brought together.

5. The electrostatic precipitator of claim 4, wherein said normally open switch is a normally open magnetic switch and the actuator is a magnet.

6. The electrostatic precipitator of claim 4, wherein said normally open switch is a normally open push button mechanical switch and the actuator is a solid surface that comes in contact with the push button of the mechanical switch thereby depressing the push button and causing the mechanical switch to be closed.

7. The electrostatic precipitator of claim 4, wherein said normally open switch is a normally open optical switch that includes a light source projecting a light beam, a light sensor, a switch that closes upon the sensing a change in light intensity by the light sensor, and wherein the actuator is a device to cause the light intensity reaching the light sensor to change when the device is brought near the light beam.

8. The electrostatic precipitator of claim 4, wherein said first housing and said second housing are made of metal.

9. The electrostatic precipitator of claim 8, wherein at least one of the housings is grounded.

10. The electrostatic precipitator of claim 4, wherein said fitting for receiving incoming gas is connected to carry gases and particulate materials from a crankcase of a diesel engine.

11. The electrostatic precipitator of claim 4, wherein the first and second housing are configured to be separable along a linear path of movement, and the separable connector having portions that separate when the first and second housing are separated.

12. The electrostatic precipitator of claim 4, wherein the first and second housings each have a peripheral flange that mates with the flange of the other housing when the housings are brought together.

13. The electrostatic precipitator of claim 12, wherein the peripheral flanges are planar.

14. An electrostatic precipitator having a high voltage precipitator electrode, and a high voltage power supply for converting an input voltage on a low voltage input line to a substantially higher output voltage at an output thereof, a first housing for housing the high voltage precipitator electrode, said first housing having an inlet for receiving incoming gas carrying particulate matter, and having an outlet for carrying gas that has passed by the high voltage precipitator electrode, and a second separate housing for housing the high voltage power supply, the first and second housings being separable and having mating supports to hold the housings together with the output of the high voltage power supply connected to the high voltage precipitator electrode, a switch on the low voltage input line to the high voltage power supply in the second housing, said switch being normally open and closeable to connect the low voltage input line to the high voltage power supply, and a switch actuator on the first housing operable to close the switch when the second housing and the first housing are positioned together on the mating supports.

15. The electrostatic precipitator of claim 14, including a first portion of an electrode connector for the output of the high voltage power supply and a second portion of an electric connector that mates with and electrically connects to the first portion when the first and second housings are positioned together on the mating supports.

* * * * *